United States Patent [19]

Moulin

[11] Patent Number: 4,963,111

[45] Date of Patent: Oct. 16, 1990

[54] WATER VEHICLE HULL WITH A COMPLIANT LOWER PORTION

[76] Inventor: Olivier Moulin, 13 chemin due Plan-du-Loup, Saint-Foy-les-Lyon, France, 69110

[21] Appl. No.: 229,856

[22] PCT Filed: Nov. 27, 1987

[86] PCT No.: PCT/FR87/00476

§ 371 Date: Jul. 12, 1988

§ 102(e) Date: Jul. 12, 1988

[87] PCT Pub. No.: WO88/03890

PCT Pub. Date: Jun. 2, 1988

[30] Foreign Application Priority Data

Nov. 28, 1986 [FR] France ..... 86 16865

[51] Int. Cl.[5] ..... B63B 35/79

[52] U.S. Cl. ..... 441/74; 114/39.2; 441/79

[58] Field of Search ..... 440/9, 61, 66; 114/352, 114/284–287, 39.2, 271; 441/74, 79, 65

[56] References Cited

U.S. PATENT DOCUMENTS

| | | | |
|---|---|---|---|
| 3,203,015 | 8/1965 | Cole | 114/285 |
| 3,317,937 | 5/1967 | Gallagher | 441/74 |
| 3,413,948 | 12/1968 | Coll | 114/285 |
| 3,527,188 | 9/1970 | Shepard | 440/9 |
| 3,565,030 | 2/1971 | Curtis | 114/66.5 |
| 3,902,207 | 9/1975 | Tinkler et al. | 441/74 |
| 3,988,794 | 11/1976 | Tinkler et al. | 441/74 |
| 4,000,712 | 1/1977 | Erikson et al. | 114/352 |
| 4,649,847 | 3/1987 | Tinkler et al. | 114/39.2 |

FOREIGN PATENT DOCUMENTS 8616461 9/1986 Fed. Rep. of Germany .

*Primary Examiner*—Joseph F. Peters, Jr.
*Assistant Examiner*—Edwin L. Swinehart
*Attorney, Agent, or Firm*—Dowell & Dowell

[57] ABSTRACT

The rear of the float (1) is cut away in order to provide said float with a lower rear portion or "lift" (4) which exhibits a certain compliance relative to the float. The rear portion or "lift" (4) is overlapped at a certain distance by a rigid body (3) which is integral with the float (1). A slot (5) is thus defined, with which a double-acting damper (6) is associated. Depending on the state of the water surface, the portion (4) assumes one of the positions C, C', C''.

10 Claims, 10 Drawing Sheets

WATER VEHICLE HULL WITH A COMPLIANT LOWER PORTION

BACKGROUND OF THE INVENTION

1. Field of the Invention

The present invention relates especially to the pursuit of a water sport, and most particularly to the water sport technique which enables a person to glide over water with the aid of a board.

This board, called a "sailboard" when the propulsive force is provided by wind pressure, and called a "surfboard" when the propulsion is provided solely by wave thrust, thus enables a person standing upright on it to execute manoeuvres on water.

2. History of the Related Art

The manner in which this water sport is practiced has undergone very considerable development in recent years. A sailboard conventionally consists of a float (or board) on which rigging - in the form of a mast - is articulated, allowing the setting of a sail which the user or "windsurfer", who stands on the float, holds in check and keeps in position by means of a bow which is called a "wishbone", the sail profile being delineated by battens. One or more fins are mounted beneath the float, in a manner such that they can be moved and/or adjusted, so as to reduce the drift of the board to leeward. The success of these sailboards has resulted in the appearance, on the market, of new models that exploit the very latest industrial technology, especially in order to improve the speed. In this regard, the shape, the hull underbody, the size and the weight are taken into consideration in order to offer the best guarantees aimed at reducing the resistance to the forward movement of the board over the water. Technical improvements have likewise been applied to the various elements of a board (the mounting of the mast and fin on rails extending over a portion of the length, the fixing of the mast to the float, the fixing of the wishbone to the mast, the provision of mast length adjustability, etc . . . ), the object being to augment the propulsive effect produced by the wind in the sail and thus to increase the propulsive force that enables the board to move over the water. Since the speed of a sailboard is proportional to the force propelling it, and inversely proportional to the resistance opposing forward movement, it will be understood that the abovementioned technical improvements have more particularly contributed to improving the speed of these boards.

There are boards of the "wave" type, on which the profile of the float undersurface has a convex curvature, and there are "speed" boards, on which the undersurface profile approximates to a straight line. It is obvious that the user will select the appropriate board according to the state of the water surface, and will for example select a speed board if the water is very smooth. This makes it necessary to own several boards or similar vehicles, which entails considerable expense, as well as transport problems. Should a user make do with owning only one board, its efficiency will be very poor when it has to be used under water surface conditions other than those for which it was designed.

In order to remedy these disadvantages, consideration has already been given to making a relatively short slanting slot in the rear of the float, the compliance being controlled solely by a spring or a "silentbloc". The deformation of this board corresponds only inaccurately to the loads imposed on it, since any deformation is distributed over too short a portion of its length.

This board, so to say, is never wholly suited to the essential conditions, namely the weight of the windsurfer, the "hardness" of the water surface, the wavelet height, etc. . . .

The refinements which are the object of the present invention are aimed at remedying these disadvantages, and at facilitating the production of a vehicle which, while of the type specified earlier in this document, satisfies the requirements of the technique under consideration, and does so more effectively than has previously been the case.

SUMMARY OF THE INVENTION

The resilient rear portion is situated on the rear third of the said board, which utilizes controlled deformation of its rear plane, or lower "lift", in order to enable it to assume the shape of the water surface on which it is moving, and on which there will be more or less pronounced waves. This lower plane therefore deforms in accordance with the loads that the water surface imposes on it during its movement, but it also deforms in accordance with the weight of the windsurfer who is present on the deck of the board. The compliance of this deformable "lift" has thus to be adjusted to suit the individual windsurfer, and this is achieved by subjecting the "lift" to an opposing reaction force that is supplied through the agency of a double-acting damping device. The damping device is preferably constructed as a bellows, its hardness being adjustable by varying the pressure to which it is inflated by means of an inflator of a type in common use. The actual damping can be adjusted by means of an air-admission restrictor.

The hull according to the invention comprises a rear portion which is resiliently connected or articulated to the remainder of the hull, and which at the same time defines a transverse slot within the hull, the rear portion extending over at least one third of the total hull length and a double-acting damping device being installed within the slot in order to control its opening and/or closing movements under the action of the forces exerted by the water.

This invention represents a very important technical advance, because it involves a compromise between the "camber" (longitudinal section ) of a sailboard, a wave board and a speed board, and because it enables this board to match its shape to that of the water surface, with which it thus achieves better contact by exploiting the compliance of its rear third.

The damping device avoids the phenomenon of bouncing, which is also undesirable.

The slot is of considerable length, and it is difficult both to produce such a slot and to install the damping device when the necessary operations have to be performed on a one-piece hull.

The present invention, moreover, sets out to permit the production of a hull that consists of two separate elements, namely the main, rigid hull body - i.e. the hull deck plus a portion of the hull underbody - on the one hand, and the compliant lower rear portion, on the other hand.

The entire assembly can thus be produced by molding, and industrial production becomes easy. Moreover, this design provides free access to the damping device, and allows various elements to be interchangeable. Lastly, another advantage, specific to the invention, resides in the fact that each of the two separate elements is absolutely watertight.

The attached drawing is given by way of an example, and will allow better understanding of the invention, its characteristics, and the advantages which it can provide.

BRIEF DESCRIPTION OF THE DRAWINGS

FIG. 1 shows the float 1 of a sailboard, together with part of its rigging 2.

DESCRIPTION OF THE PREFERRED EMBODIMENT

According to the invention, the float 1 comprises a first element 3, corresponding to the plan outline of the sailboard, which is produced in the usual manner as a carbon such as "Kevlar" fiber laminate that endows it with the greatest possible rigidity, while at the same time acknowledging the need for a lightweight structure. This element supports the weight of the windsurfer and thus has to have adequate strength. The rear portion of this element continues in the form of a compliant portion, 4, which may for example be produced as a glass fiber laminate, and which deforms, relative to the element 3, by virtue of the fact that its sole connection to element 3 is via a thin butt end 4*a*. The element 3 overlaps the portion 4 to a very substantial extent, but at a certain distance from it, so as to define a transverse slot, 5, which extends across the entire width of the float so as to emerge on each of its sides. The lower face of the slot is of course formed by the upper surface 4*b* of the portion 4, whereas its opposite face is formed by a wall 3*a* of the element 3. It will be noted that the total length of the portion 4 is, with advantage, equal to approximately one third of the total length of the float. This wall 3*a* forms a stop surface, against which the portion 4 can come to bear when deformed upwards under extreme conditions. The portion 4 is thus subjected to controlled deformation, relative to the element 3.

At rest, the float 1 presents an undersurface profile which corresponds to that of a speed board, i.e. it assumes a shape which is virtually flat towards the rear, whereas if the portion 4 deforms upwards, the profile approximates that of a wave board, i.e. this shape is, generally speaking, an unbroken convex curve.

Figure 1:
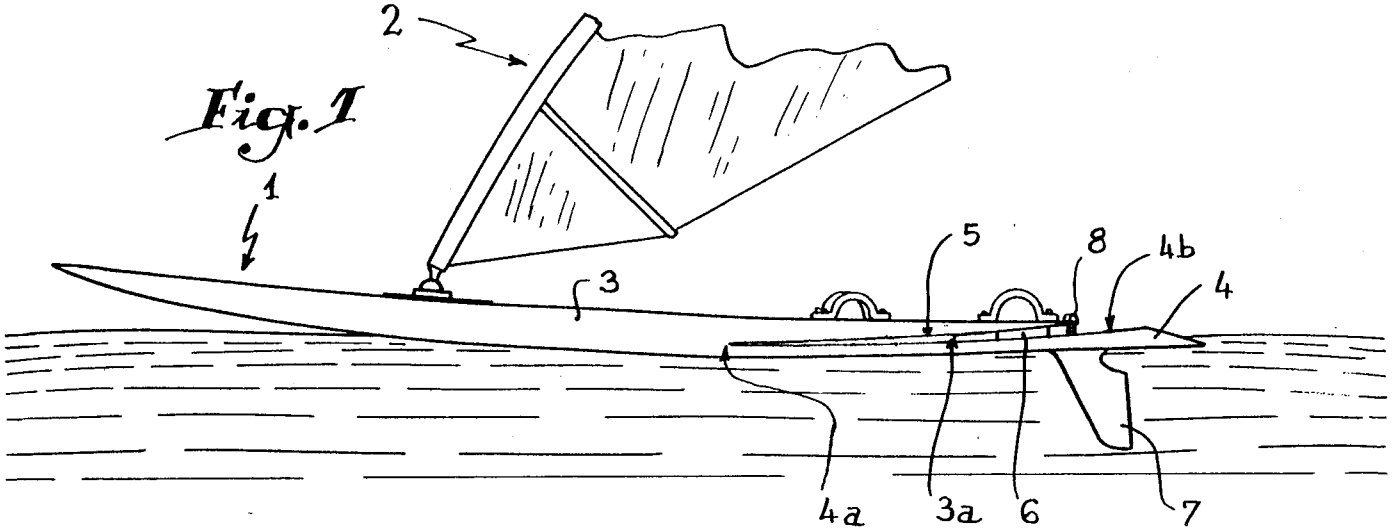
FIG. 1 is a side view of a sailboard with a float embodying the refinements according to the invention.
Figure 2:
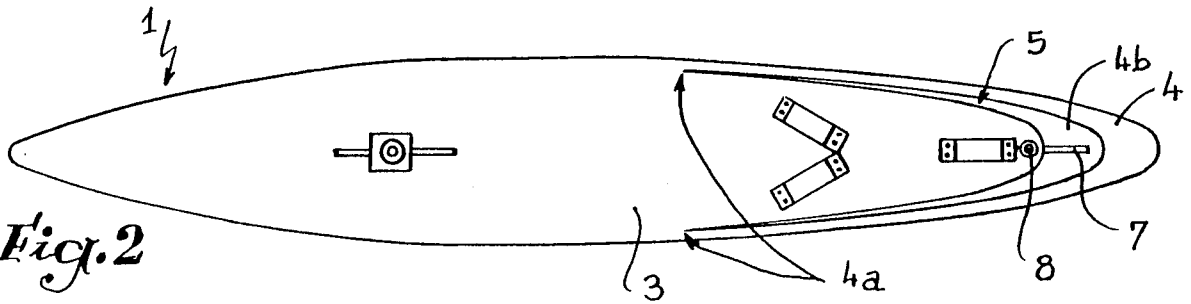
FIG. 2 is a top plan view, the rigging being omitted.

By virtue of its structure, the portion 4 provides a certain reaction force which opposes extraneous forces tending to deform it, due to factors such as the weight of the windsurfer, the shape of the water surface, etc . . . However, this force is not large enough, so a system constructed in the form of a pneumatic spring has been inserted between the upper surface 4*b* and the wall 3*a*, with a view to presenting an additional force that can be proportionately varied through the agency of the pressure to which it is subjected. In FIG. 1, this system is marked 6.

It will also be noted that the undersurface of the portion 4 is provided with a fin 7. Depending on the shape of the wavelets, the user can, on setting out, adjust the opening of the slot 5 by rotating an adjusting screw, 8, which defines its maximum opening. This adjusting screw passes through a combined slide and stop, 9, which is securely fixed to the element 3, and its free end rotates in a nut, 4*c*, which is inset into the portion 4. Rotating the screw thus enables the upper surface 4*b* of the portion 4 to be moved closer to the wall 3*a* of the element 3 (for example when the wavelets or waves are large), so as to raise the portion 4 from its free position, indicated by dotted lines in FIG. 3 and marked 4', to the position indicated by continuous lines. In this Figure, the highest position of the portion 4 is represented by broken lines, and is marked 4''.

Figure 4:
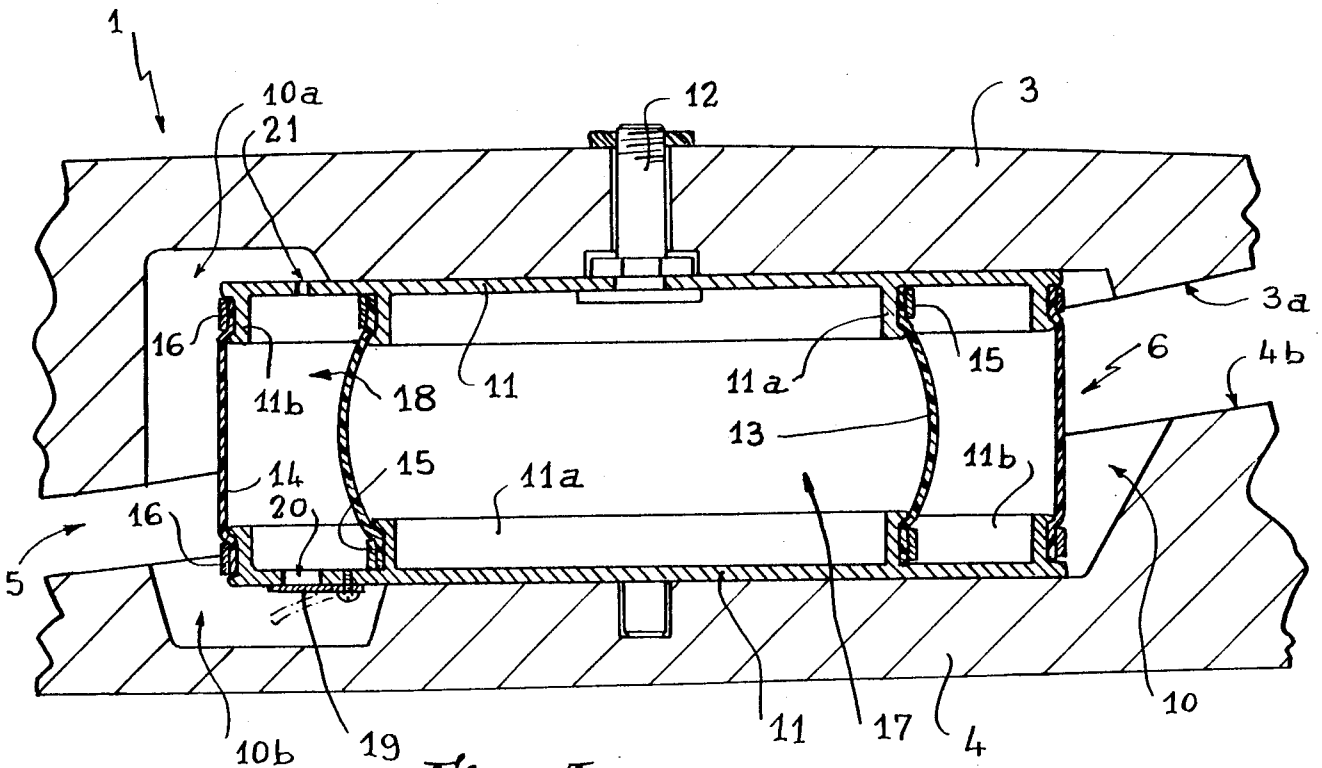
FIG. 4 is a view on a larger scale, in transverse section, of the system for damping the displacement of the rear portion of the float, relative to the remainder thereof.

FIG. 4 illustrates the preferred embodiment of the damping system that is installed within the slot 5. For this purpose, the slot includes a cavity, 10, which is formed in both the element 3 and the portion 4, the opposing, horizontal faces of this cavity being provided with two end plates 11, each possessing two concentric ribs, 11*a*, 11*b*, which are located opposite their counterparts on the other end plate. The center of the upper end plate 11 carries a valve, 12, which projects above the upper surface of the element 3.

Two elastic membranes 13, 14, made of a material such as natural rubber or synthetic rubber, are securely fastened to corresponding ribs 11*a*, 11*b*, so that they extend between them. The method by which the membranes are fastened to the ribs is not rigorously specified. Simple clamping bands 15, 16 are shown in the drawing, but any other means could be chosen. The membrane 13 defines a resilient vessel 17, whereas the membrane 14 forms an annular chamber, 18, which encircles the vessel 17. A flap valve 19 is provided in the chamber 18, this valve being designed to seal or open a hole 20, made in one of the end plates, whereas a calibrated orifice 21 is bored in the other end plate, preferably opposite the hole 20.

It is obvious that the cavity 10 includes depressions 10*a*, 10*b*, ensuring that the hole 20 and orifice 21 communicate with the slot 5. It should be noted that advantages accrue if the volume of the chamber 18 is at least three times that of the vessel 17.

In order to use a sailboard of the design according to the invention, the size of the slot 5 is set before pressurizing the vessel 17, so that any displacement of the portion 4 will be checked by the flattening of this vessel. This flattening deforms the membrane 13, which distends outwards in a manner such that the air contained within the chamber 18 is expelled via the hole 20, which is obstructed by the flap valve 19.

Figure 3:
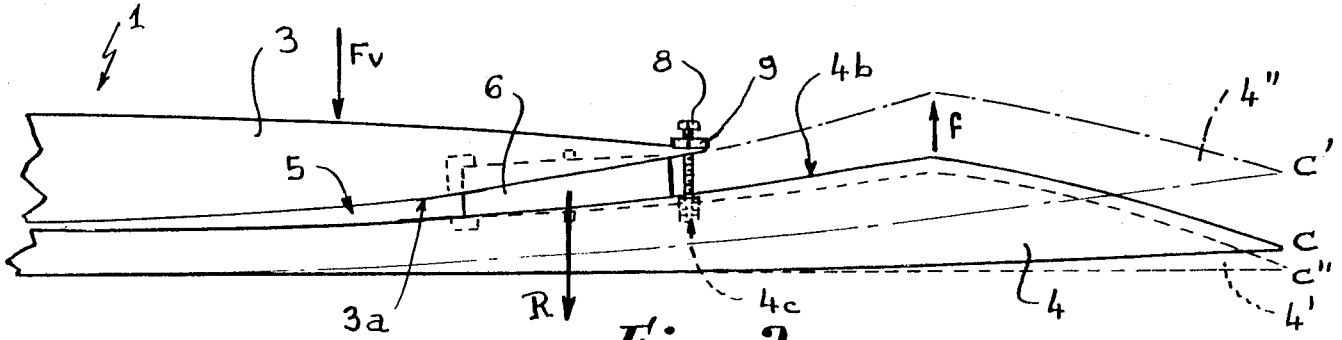
FIG. 3 is a side view, showing part of the rear of a float according to the invention.

When the portion 4 tends to return to its initial position as a result of resilience, the flap valve 19 closes, and air enters the chamber 18 via the calibrated orifice 21, thus damping the return movement of the portion 4. Under these conditions, when the windsurfer is sailing with the aid of a board of the design according to the invention, the shape of its float adapts itself to match the wave profile, by virtue of the compliance of the portion 4. Under the influence of a wave, the sustaining force increases, and a force f is momentarily created, which tends to displace the portion 4 upwards (FIG. 3). If this force f exceeds the resistance, R, which the resilient vessel 17 develops over the portion 4, this portion rises, partially closing the slot 5. When the force f diminishes, the resistance R reverts to its original value and the portion 4 returns to its initial position, which is limited by the setting of the screw 8, as already explained. The undersurface of the float 1 thus returns to its initial shape.

If the water surface is calm, the undersurface of the float 1 therefore resembles that of a speed board, so that the sailboard can move over the water without drag, and hence at a higher speed, which is not the case when the user has to make do with a wave board with a float undersurface that is convex in the longitudinal direction.

On the contrary, if the water surface is disturbed by waves, the portion 4 deforms in a manner such that the float undersurface assumes the curved shape of a wave board.

The refinements according to the invention also prove advantageous during turns.

Figure 6:
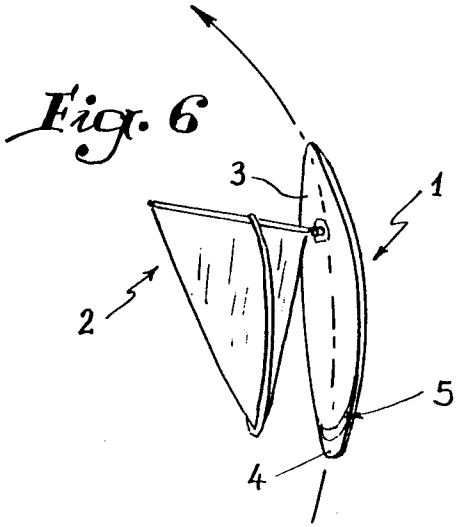
FIG. 6 shows a sailboard that is performing a turn, viewed from above.
Figure 5:
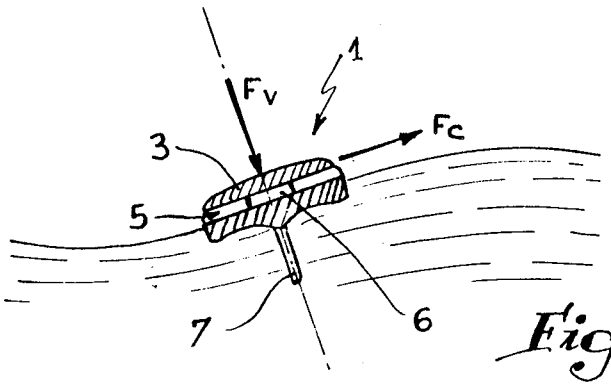
FIG. 5 shows the position of the float of a sailboard during a turn.

In fact, in order to execute a turn, the windsurfer must perform what in snow skiing is called "gripping with the edges"—i.e. he has to incline his board towards the inside of the turn, as illustrated in FIG. 5—and this action manifests itself by a centrifugal acceleration that affects his own mass, so as to augment the force FV which he applies to the upper surface of the element 3. Moreover, this position gives rise to a centrifugal force, FC. These two forces will create a reaction which will constrain the resilient vessel 17 to flatten to a proportionate extent, such that the curvature of the undersurface of the float 1 will increase until it assumes the radius of curvature corresponding to the turn illustrated in FIG. 6. When the turn ceases, the centrifugal force vanishes, the force FV reverts to its normal value and the float portion 4 returns to its initial position.

Thus, in this case as well, a sailboard float has been produced, which is as manoeuvrable as a so-called wave board, while being capable of effective use as a speed board on recovering from a turn.

As indicated previously, modification of the curvature of the undersurface of the float 1 therefore makes it possible to avoid the drag effects generated by float shapes which are not conformal with the water surface.

It is self-evident that although the whole of the foregoing description relates to a sailboard float, the refinements according to the invention could be applied to a water vehicle hull such as that of a motorboat or sailing boat.

Figure 7:
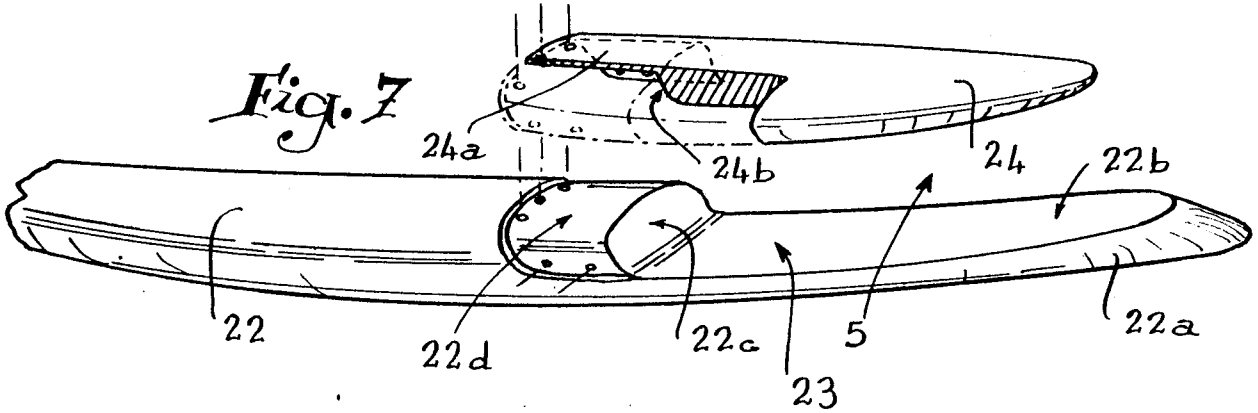
FIGS. 7, 8 and 9 illustrate three embodiments of the hull according to the invention.

In the embodiment shown in FIG. 7, the hull comprises a float 22, its prow being omitted from the drawing. This float 22 is made thinner towards the rear by making a cutaway 23, leaving a compliant lower rear portion 22*a* on the float. The length of this portion is equal to at least approximately ⅓ of the total length of the float 22, for reasons which will be explained more clearly later on. The face 22*c*, situated between the face 22*b* and the forward portion of the float 22, is curved so as to be concave towards the rear. In effect, its shape is that of a portion of a cylinder.

The second component of the hull according to the invention is produced as a foam-filled laminated element, 24, which is extended by a wall 24*a* in the shape of a cap that is designed to cover the greater portion of that zone 22*d* of the float 22 which adjoins the face 22*c*. The element 24 is shallower than the cutaway 23, so that the lower face 24*b* of this element is situated at a defined distance from the face 22*b*, so as to form the slot 5.

The wall 24*a* of the element 24 is rigidly fixed to the zone 22*d* of the float, in a manner such that this element 24 is conformally fitted into the float, with the result that it forms a rigid deck despite its cantilevered position relative to the said float. More specifically, this rigid conformal fitting is achieved by virtue of the fact that the front face 24*b* of the element 24 bears against the face 22*c* of the float, the two faces in question having complementary shapes. Moreover, this co-operation between these two faces constitutes a support which permits easy angular displacement of the portion 22*a* of the float, relative to its forward portion.

Figure 8:
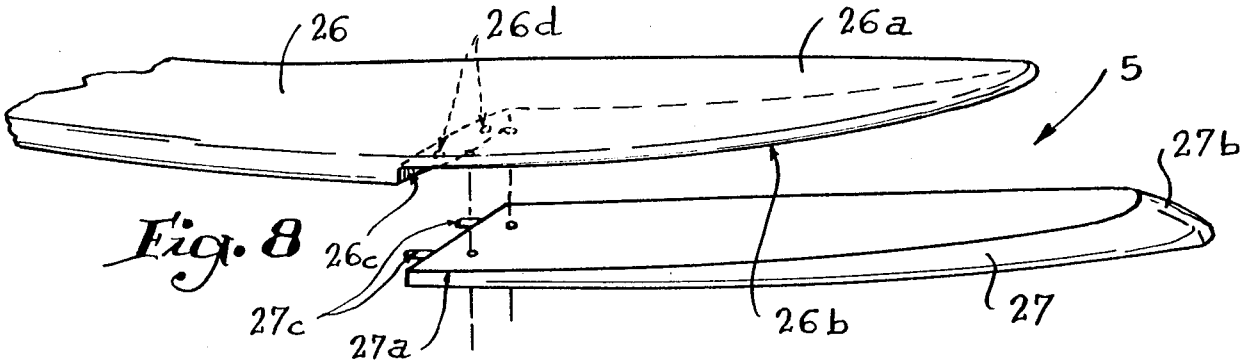

In the embodiment shown in FIG. 8, the hull is formed, as in the embodiment shown in FIG. 7, by a float 26, only its rear portion being depicted. The underbody of this rear portion is cut away in a manner such that at this level the float presents a reduced-thickness deck 26*a*, situated above an empty space 26*b*. The deck 26*a* is designed to be rigid, and the connection between it and the float is consequently configured as a vertical face 26*c*.

The second component of the hull constructed in conformity with the second embodiment according to the invention is produced as a foam-filled laminated element or blade, 27, which is given a slanting shape in that its end, 27*a*, which is intended to co-operate with the float face 26*c* is made much thinner than its end 27*b*. In any case, the thickness of the blade 27 is such that, in conjunction with the lower face of the deck 26*a*, it defines the slot 5.

The end 27*a* of the blade 27 is rigidly flush-fitted to the float 26, for example with the aid of dowel pins, 27*c*, which fit into holes 26*d* in the float 26, while this particular end can be mounted flat against the corresponding end of the lower face 26*b*, over a short distance, by means of bolts which are not shown in the drawing, or by other fasteners. The deformation of the blade—or "lift"—consequently occurs by virtue of its own compliance.

Figure 9:
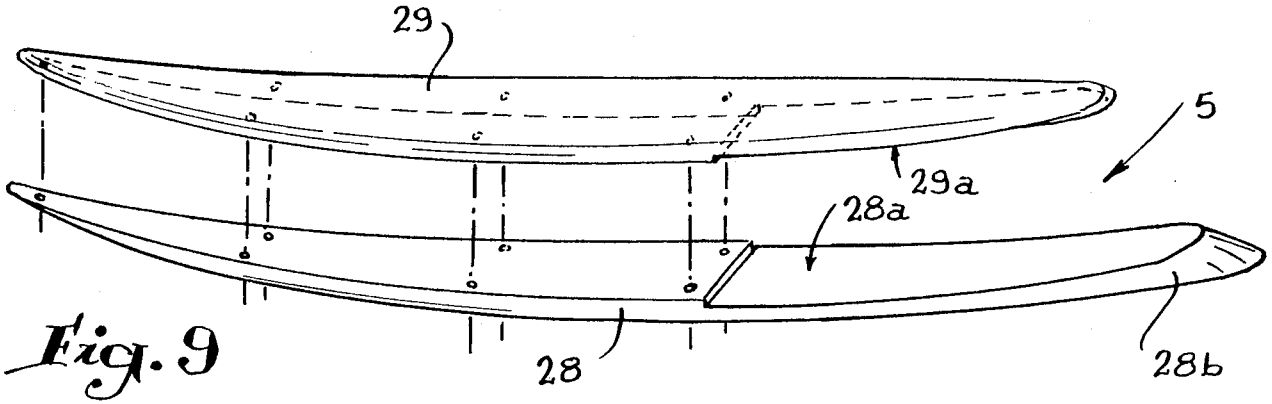
Figure 10:
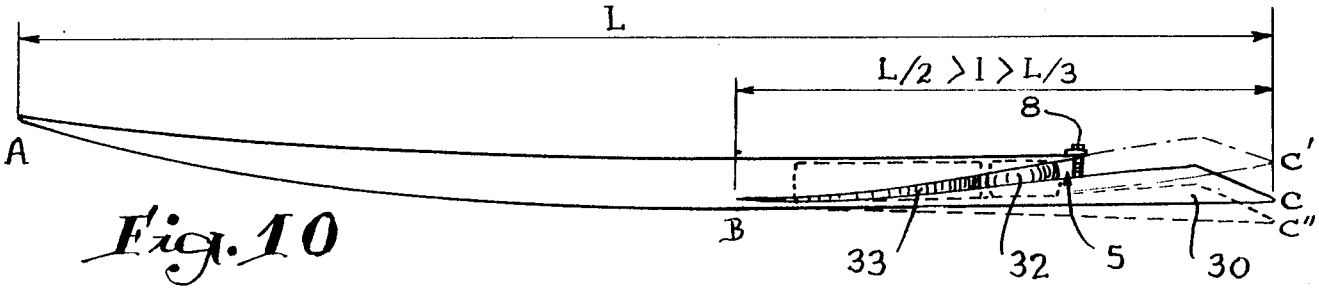
FIG. 10 is a side view of a water vehicle hull, in particular a sailboard hull, constructed in accordance with a preferred embodiment of the invention.

In a third embodiment, illustrated in FIG. 9, the hull is formed by an underbody 28, its upper face being relieved over an area, 28*a*, which defines the compliant rear portion 28*b*, as well as by a deck 29, the length of which is similar to that of the hull underbody 28. The rear portion of this deck is designed to be rigid, and is situated above the relieved area 28*a*, so as to define the slot 5, as shown in FIG. 10. Another relieved area, 29*a*, can be fashioned in the lower face of the deck, so as to contribute towards defining the slot in question.

The deck and hull underbody are, of course, rigidly united between the prow formed by these two elements and the station at which the relieved areas 28*a*, 29*a* begin. Irrespective of how this is accomplished, the resulting hull exhibits a compliant rear portion which extends over at least ⅓ of the total hull length, and which can indeed be made as long as half the total length.

It will be seen that the forward portion or forebody of the hull underbody, namely the portion extending from the prow A to the beginning B of the slot 5 (FIG. 10), is outwardly convex in the longitudinal direction. This shape is important with regard to surmounting waves and wavelets. The lower rear portion of the hull, between its end marked C and the point B, is straight when at rest, this being the sustaining portion of the hull. The wetted area of this portion decreases as the speed increases, and contracts rearwards. It is imperative that the deformation of the compliant rear portion, which will henceforth be called the "lift" 30, should begin at the point B, so that this deformation is well within the continuation of the forebody curve AB. This is the reason why the length 1 of this portion has to be at least ⅓ of the total hull length L, if not as much as ½ of the total length.

As the lift 30 moves towards two other positions, C′ and C″, it departs progressively from the shape which it exhibits in the free state, position C′ being the one assumed during movement on a water surface with waves, or the position corresponding to the radius of curvature of a turn, as indicated previously, whereas the second position corresponds to the shape of the board when at the crest of a wave.

This last-mentioned position, marked C″, is reached when the hull surmounts a wavelet or a wave, and is such that it allows the sustaining force to be rebalanced following its decrease under the effect of the reduced gravity due to surmounting the wave crest. Under these conditions, the hull according to the invention always remains in contact with the water. In general terms, a point of inflection is in fact situated between the points B and C″.

Figure 11:
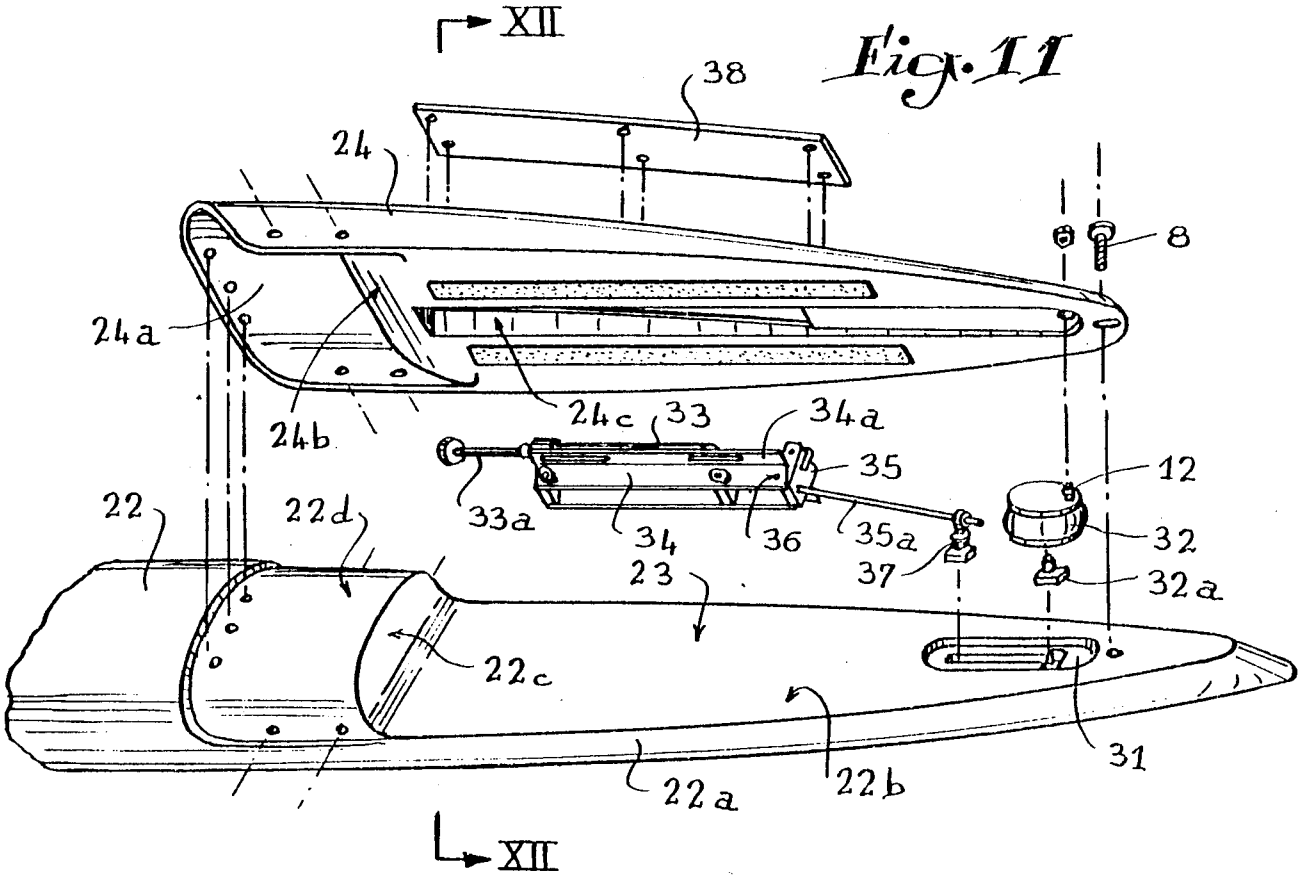
FIG. 11 is an exploded perspective view, on a larger scale, showing details of an embodiment similar to the one shown in FIG. 7.

FIG. 11 illustrates the embodiment of the invention that is preferred from the industrial point of view.

This Figure corresponds to FIG. 7, and in it will be seen the float 22, the laminated body or deck 24, possessing the wall or cap, 24*a*, which will be rigidly attached to the zone 22*d* of the said float 22, as well as the faces 24*b* and 22*c*, which contact each other in order to improve the rigidity of the body 24 above the portion 22*a* of the float 22.

Figure 12:
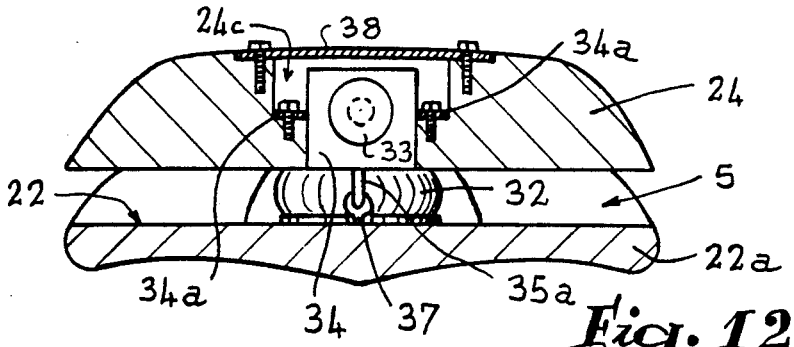
FIG. 12 is the section along the line XII—XII in FIG. 11.

A cavity 31 has been sunk in the float portion 22*a*, this cavity housing a resilient vessel, 32, which is provided with an inflation valve of the pattern shown at 12, and a thimble 32*a* for centering with respect to the bottom of the cavity 31. The slot opening when at rest is defined by the inflation of the vessel 32, and here it is possible to attach the adjusting screw, 8, which has already been mentioned. A double-acting damper 33 is mounted on a frame 34, fixed inside a cut-out 24*c* by means of ears, 34*a*, which are securely fastened to shoulders of the cut-out. The operating rod of the damper is connected to a rocker, 35, which is mounted in a manner such that it can rotate about an axle 36. This rocker 35 is equipped with a rod, 35*a*, which is connected to a ball-type self-aligning eye 37, securely fastened inside the cavity 31. The damper, which is securely fastened to the rigid deck 24, is thus connected to the compliant rear portion 22*a* of the float 22, so that any displacement of the rear portion 22*a* relative to the deck 24 is damped, irrespective of the direction in which it occurs. A screw 33*a* enables the firmness of the damping to be adjusted. The cut-out 24*c* is closed by a cover, 38, which lies flush with the upper surface of the deck 24 and forms an inspection door for the mechanism described above (FIG. 12).

Figure 14:
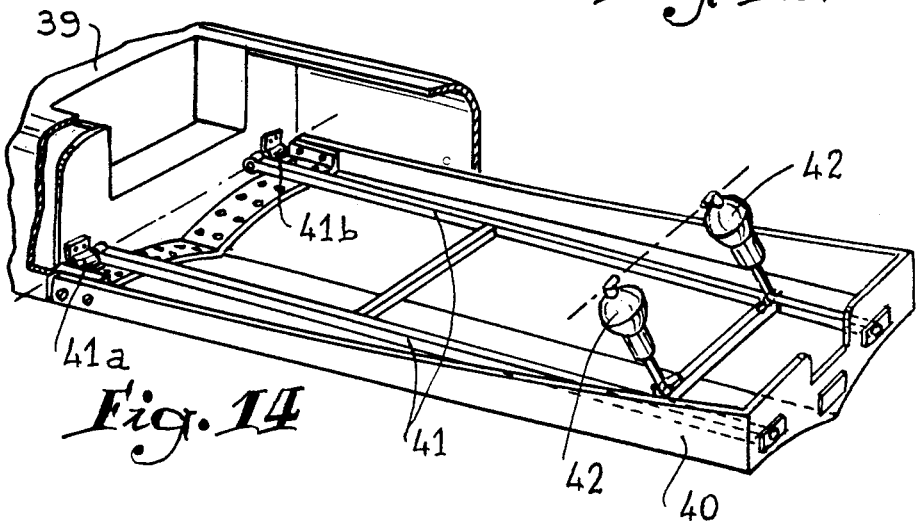
FIG. 14 is a perspective detail view of the compliant rear portion of the hull shown in FIG. 13.
Figure 15:
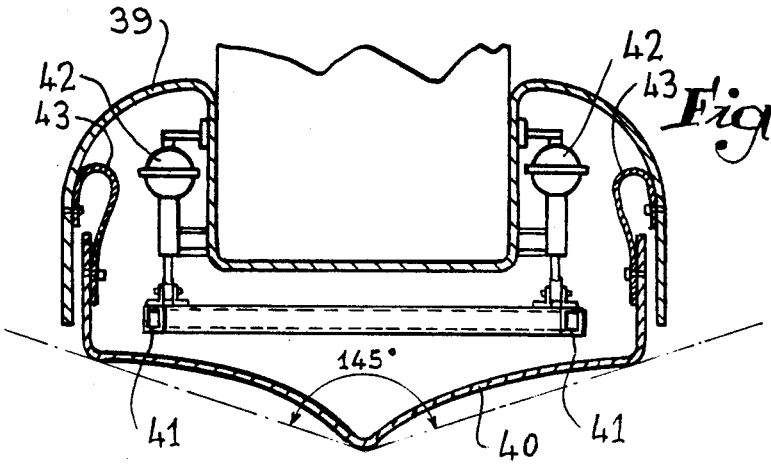
FIG. 15 is a transverse section of the vehicle shown in FIG. 13, along the line XV—XV.
Figure 13:
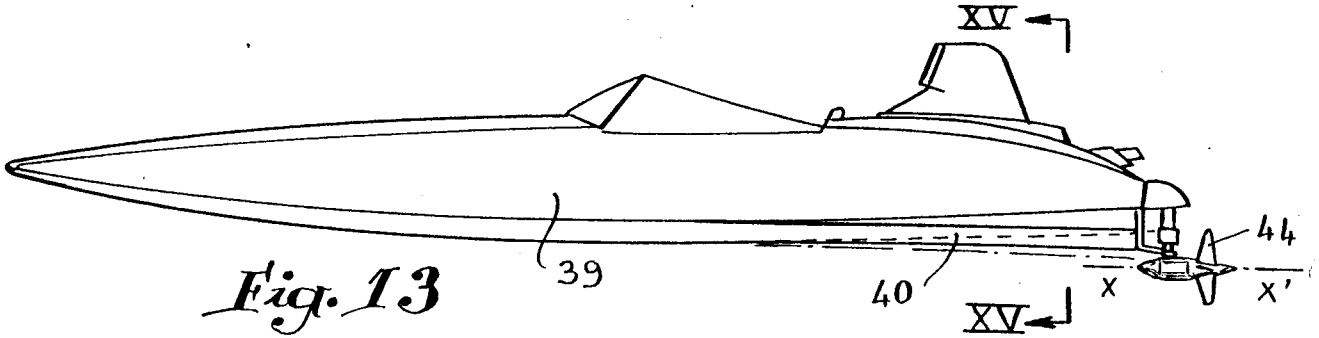
FIG. 13 illustrates a power-driven water vehicle, in side view, this vehicle having a hull that has been constructed in accordance with the invention.
Figure 16:
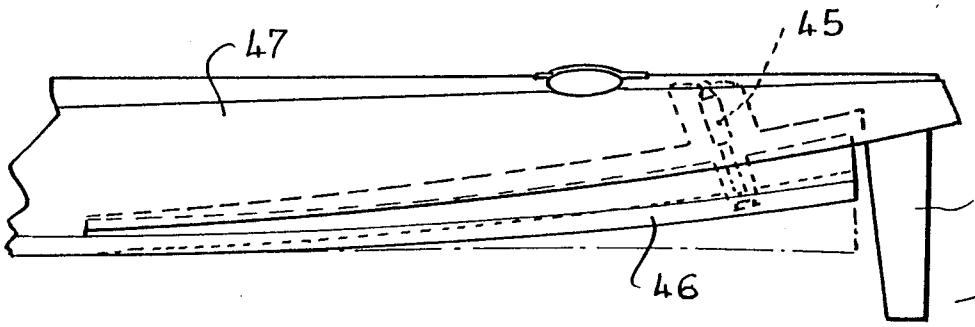
FIG. 16 shows the rear of a hull that is utilized for producing a monohull or multihull sailing boat.
Figure 17:
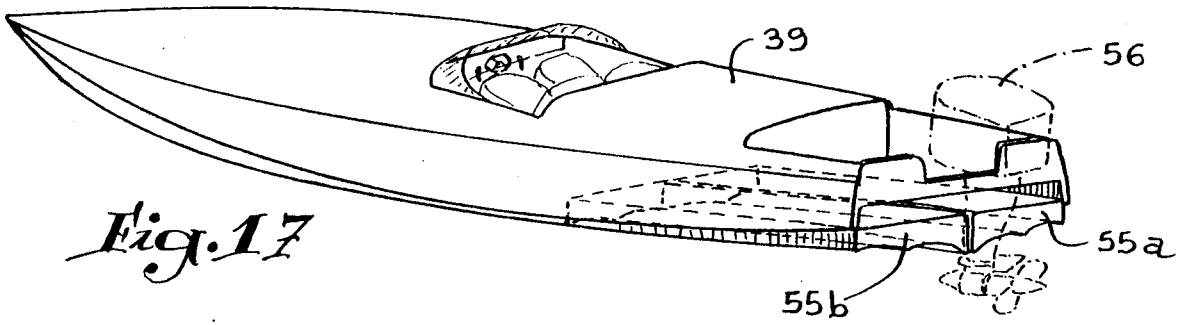
FIG. 17 shows a hull that is utilized for an outboard-engined vehicle.
Figure 18:
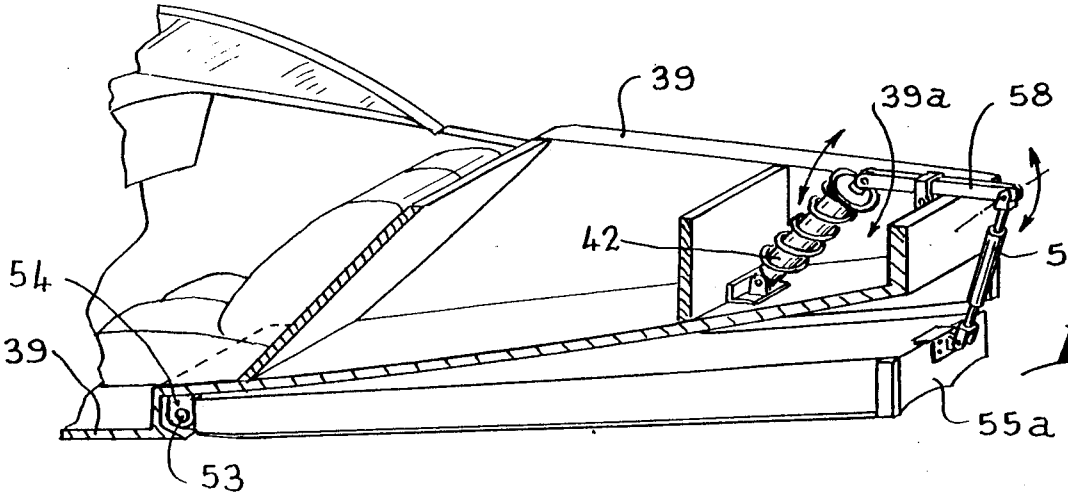
FIG. 18 is an exploded view of the hull, emphasizing the articulation system of one of the sustaining planes.
Figure 19:
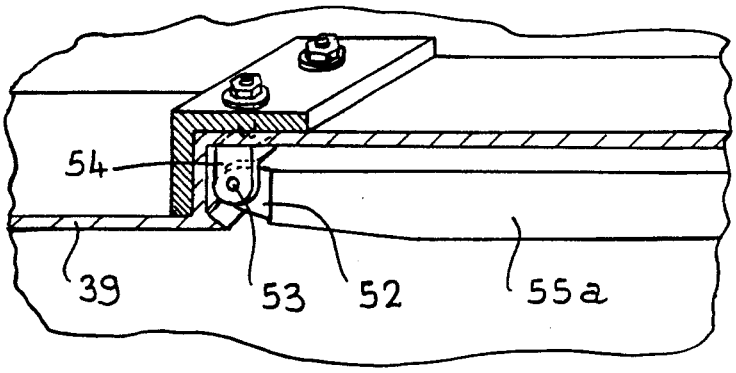
FIG. 19 is a detail view, on a larger scale.

The hull according to the invention can be utilized for constructing a power boat, such as the one illustrated in FIG. 13. The rear portion of its hull 39 is illustrated in FIG. 14. This rear portion is either flexible or articulated, and is constructed in the form of a lift or sustaining plane, 40, which is associated with a frame 41. This frame 41 is provided with two horizontal pivots, 41*a*, 41*b*, which are installed in a manner such that rotation can occur relative to bearings that are incorporated into the hull 39. The frame 41 is connected to the hull by means of two dampers 42, these being of the oleo-pneumatic, adjustable-pressure type (FIG. 15). Water-excluding skirts 43 are fitted between the hull 39 and the lift or sustaining plane 40.

In transverse section, as illustrated in FIG. 15, the undersurface of the lift or sustaining plane 40 presents the shape of an angle with curved sides, its vertex being approximately 145°.

It will be noted that the axis X, X′, about which the boat propeller 44 rotates, should advantageously be situated at a constant distance from the bottom of the lift 40, and in consequence of this, means are provided for shifting the propeller vertically, according to the angular position of the lift in relation to the hull 39.

In one advantageous embodiment of the invention, as illustrated in FIGS. 17 to 20, the lift or sustaining plane 40 has been formed by mounting two planes 55*a*, 55*b* side by side, each being articulated to the hull 39. Each of the dampers 42 influences one of these planes 55*a*, 55*b*, which are articulated to the hull 39 via lugs 52 and the pins 53 of clevis fittings 54, the lugs forming extensions of longitudinal stiffeners associated with the planes 55*a*, 55*b*. In fact, the hull extends above the two planes 55*a*, 55*b* in order to carry an engine 56, and to form a compartment, 39*a*, which houses the two dampers 42. In this embodiment, each damper rod is coupled to a lever, 58, which is articulated to the end of a connecting rod, 59, which serves as an adjuster.

It is obvious that the deformations of the lift or lifts or sustaining planes of the boat in question take place in the same way as those displayed in FIG. 10, i.e. from the neutral position C, towards the position C′ or the position C″.

Figure 20:
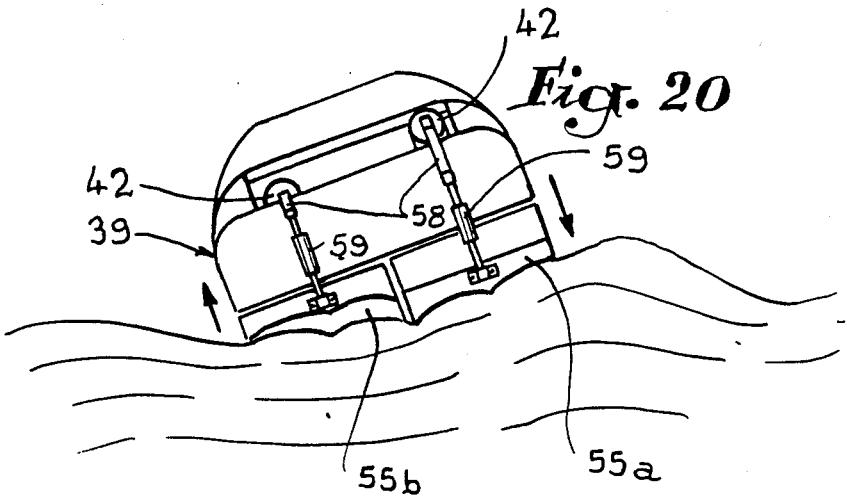
FIG. 20 shows the position of the float of a power boat during a turn, with the deflection of its sustaining planes.

FIG. 20 provides a better understanding of the mode of operation during a turn to the left. The flat-bottomed boat applies more pressure to the articulated plane 55*b* and less to the plane 55*a*. This manifests itself by inward displacement of the plane 55*b*—i.e. it moves towards the point C′—and by relaxation of the plane 55*a*, which moves towards the point C″ (see FIG. 10), these movements bringing about the inclination of the hull that allows it to turn.

It will be noted that any means of propulsion can be envisioned, outboard or inboard, subject to the condition that the propeller is kept sufficiently far below the lines along which the water leaves the hull underbody, so that the propeller does not become affected by cavitation.

A flat-bottomed boat which is provided with multiple sustaining planes 55*a*, 55*b*—either flexible or articulated—can be equipped with a control system equivalent to that of an aircraft: i.e. directional control is exercised by a rudder bar device (foot control) and a joystick device, this system being capable of controlling both the lateral trim and the longitudinal trim by mixing the right/left and backward/forward movements, provided that the boat has oleo-pneumatic dampers which offer the possibility of continuously varying the neutral operating point C, and thus the possibility of differentially positioning the right-hand and left-hand sustaining planes (FIG. 20) in order, for example, to initiate a turn or to rebalance the hull.

It would also be possible to envision the installation of a plurality of lifts or sustaining planes in tandem in the longitudinal direction, while remaining within the scope of the invention.

A hull according to the present invention can likewise be utilized as a float for a monohull or multihull sailing boat. Under these conditions, dampers 45, which can be hydraulic, or can be of some other type, are mounted between the lift 46 and the rigid float 47, so as to replace the damping device that was designed for sailboards.

It will be seen that the rudder 48 has to be rotatably mounted in a vertical bearing which forms part of the rigid float 47, i.e. it must not change its position according to variations in the orientation of the lift 46. Moreover with a view to facilitating operation of the rudder, the axis on which it pivots is situated on the axis passing through its center of pressure.

The refinements to which the present invention relates thus allow any type of water vehicle hull to be produced industrially, irrespective of whether it is intended for a sailboard, a power boat or a sailing boat, these hulls comprising a rear portion which is either flexible or articulated, and which is connected to the float by means of a double-acting damping device.

What is claimed is:

1. A hull for a water vehicle comprising a main portion and auxiliary portion, said main portion having front and rear sections, the hull being of a first length, said auxiliary portion being connected to said main portion so as to be in generally opposing relationship with respect to said rear section thereof, said rear section of said main portion and said auxiliary portion having opposing faces, a slot defining a spacing between said opposing faces of said auxiliary portion and said rear section of said main portion, said slot extending at least one third of the first length of the hull, said auxiliary portion and rear section of said main portion being relatively yieldable with respect to one another so as to vary the spacing therebetween, a double-acting damping means mounted within said slot, said double-acting damping means including a pressurized resilient vessel installed between said opposing faces of said rear section and said auxiliary portion, an elastic membrane encircling said vessel and defining a chamber, said chamber including an evacuation valve for selectively opening said chamber to atmosphere and an inlet orifice for permitting air to enter said chamber.

2. The hull of claim 1 in which said vessel includes a pair of opposing end plates mounted to said opposing faces of said rear section and said auxiliary portion, each of said plates having first and second rib means, said second rib means being spaced outwardly of said first rib means, an elastic partition means secured to said first rib means, and said elastic membrane being connected to said second rib means.

3. The hull of claim 2 in which each of said opposing faces of said rear section and said auxiliary portion include cavities which are open to atmosphere through said slot, said evacuation valve being mounted through one of said end plates so as to communicate with one of said cavities and said inlet orifice being provided through the other of said end plates so as to communicate with the other of said cavities.

4. The hull of claim 2 wherein the hull includes an upper surface, an inflation valve fitted to one of said end plates, said inflation valve being accessible from said upper surface of the hull and being utilized for inflating said vessel.

5. The hull of claim 1 in which said chamber defines a first volume and said vessel defines a second volume, said first volume being at least three times as large as said second volume.

6. A hull for a water vehicle comprising a main portion and an auxiliary portion, said main portion having front and rear sections, said hull being of a first length, said auxiliary portion being connected so as to be in opposing relationship to said rear section of said main portion, said rear section of said main portion and said auxiliary portion having opposing faces, a slot defining a spacing between said opposing faces of said auxiliary portion and said rear section of said main portion, said slot extending at least one third of the length of the hull, said auxiliary portion and rear section of said main portion being relatively yieldable with respect to one another so as to vary the spacing therebetween, a double-acting damping means mounted within said slot, said damping means including a resilient vessel which is pressurized at a predetermined pressure and a damper means having a pivotable rocker element, said damper means being mounted between said opposing faces of said rear section and said auxiliary section and including a rod extending from said rocker element to one of said opposing faces so that as said auxiliary portion and said rear section yield relative to one another, said rod will pivot said rocker element.

7. The hull of claim 6 in which said damper means includes an adjustment means for regulating the firmness of said damper means.

8. A water vehicle hull comprising a main portion having front and rear sections, a lower surface and a rigid upper deck, the hull having a first length, an auxiliary portion being yieldably connected to the lower surface of said main portion so as to be in opposing relationship with respect to said rear section thereof, said rear section and said auxiliary portion having opposing faces, a slot defining a spacing between said opposing faces of said auxiliary portion and said rear section, said slot extending at least one third of the first length of the hull, said auxiliary portion including a frame which is pivotally mounted with respect to said main portion, a double-acting damper means mounted between said auxiliary portion and said rear section, said double-acting damper means including adjustable pressure dampers connected to said frame means, and water excluding flexible skirt means mounted between said auxiliary portion and said rear section.

9. The hull of claim 8 including a propeller means mounted to said rear section of said main portion, said propeller means including a propeller rotatable about an axis, and means for mounting said propeller means to said rear section so that the axis of the propeller is maintained at a constant vertical distance with respect to said auxiliary portion regardless of the relative yielding movement of said auxiliary portion.

10. The hull of claim 8 wherein said auxiliary portion is formed of side-by-side independently moveable sections each of which is pivotally secured to said float and a double-acting damping means connected each of said sections to said float.

* * * * *